US006159113A

United States Patent [19]

Barber

[11] Patent Number: 6,159,113

[45] Date of Patent: Dec. 12, 2000

[54] BASEBALL STRIKE INDICATOR

[76] Inventor: Donald Barber, 299 Mill Road, Apt 1608, Etobicoke, Ontario, Canada, M9C 4V9

[21] Appl. No.: 09/397,101

[22] Filed: Sep. 16, 1999

[51] Int. Cl.[7] ..... A63B 69/00

[52] U.S. Cl. ..... 473/454; 473/152; 473/155

[58] Field of Search ..... 473/454–456, 473/152, 155, 192, 199, 459, 473, 490, FOR 104, 156, 198; 273/371, 348

[56] References Cited

U.S. PATENT DOCUMENTS

| | | | |
|---|---|---|---|
| 2,113,899 | 4/1938 | Oram . | |
| 2,943,141 | 6/1960 | Knight . | |
| 3,157,399 | 11/1964 | Gaudet . | |
| 3,759,528 | 9/1973 | Christophers et al. | 473/152 |
| 4,563,005 | 1/1986 | Hand et al. | 473/454 |
| 4,577,863 | 3/1986 | Ito et al. | 473/454 |
| 4,770,527 | 9/1988 | Park . | |
| 5,230,505 | 7/1993 | Paquet et al. . | |
| 5,333,855 | 8/1994 | Silin et al. | 473/454 |
| 5,401,016 | 3/1995 | Heglund et al. . | |
| 5,553,846 | 9/1996 | Frye et al. . | |
| 5,577,733 | 11/1996 | Downing | 273/348 |
| 5,626,526 | 5/1997 | Pao et al. | 473/152 |
| 5,676,607 | 10/1997 | Stumpf | 473/455 |
| 5,833,549 | 11/1998 | Zur et al. | 473/199 |

*Primary Examiner*—Jeanette Chapman
*Assistant Examiner*—Mitra Aryanpour
*Attorney, Agent, or Firm*—Barrigar & Moss; David Greer; Dolly Kao

[57] ABSTRACT

Light indication apparatus for baseball includes a first light source for emitting first coherent and intense light rays of a first color in a first direction and a second light source for emitting second coherent and intense light rays of a second color in a second direction. The first and second light rays intersect entirely within a preselected volume. A baseball can be identified by an observer of said first and second light rays as being substantially within said volume when said first and second light rays shine on said object simultaneously.

18 Claims, 5 Drawing Sheets

BASEBALL STRIKE INDICATOR

BACKGROUND OF THE INVENTION

This invention relates to laser indicator devices used in sporting-type games. More particularly, this invention relates to laser indicator devices used in baseball games.

In the game of baseball, a pitcher will throw a "strike" if he pitches a baseball through a region called a "Strike Zone". According to official baseball rules the strike zone of a batter is that area over home plate the upper limit of which is a horizontal line at the midpoint between the top of the batter's shoulders and the top of his uniform pants, and the lower level is at the hollow beneath the batter's knee cap. Furthermore, the Strike Zone is determined from the batter's stance as the batter is prepared to swing at a pitched ball. A pitched ball which passes through the Strike Zone is called a "strike". Any pitch that does not pass through the Strike Zone, and is not swung at by the batter is called a "ball".

Because a pitched baseball passes through the Strike Zone only for a fraction of a second, it is quite probable that a home plate umpire calling balls and strikes will make mistakes. For example, a baseball which passes just slightly outside of the Strike Zone might be accidentally called a strike. Accordingly, it would be advantageous to have a device which could help the home plate umpire in calling balls and strikes.

Several attempts have been made to devise strike zone indicators. For example, U.S. Pat. No. 5,676,607 issued Oct. 14, 1997 to Stumpf teaches a laser beam Strike Zone indicator. The device of the patent includes a home plate having a plurality of adjustable light beam sources which are directed upwardly from the home plate to define a vertical rectangle at the front of the home plate which represents the Strike Zone for the height of a predetermined batter.

One disadvantage of the device of this patent is that the lasers are only meant to outline portions of the edges of the Strike Zone. According to the disclosure of the Stumpf patent, it is quite possible that a ball pitched through the Strike Zone would not intersect a laser beam at all. It is noted that a laser beam passing through air is generally difficult to see. Therefore it is possible that no visual indication would be provided to a home umpire at all.

A number of devices have also been suggested for determining pitching accuracy in practice-type settings. Such devices often include light transmitters and light receivers, and indicate a strike when light is blocked by passage of a ball, see for example U.S. Pat. No. 5,230,505 issued Jul. 27, 1993 to Paquet et al., and U.S. Pat. No. 4,770,527 to Park. However, devices which make use of light transmitters and corresponding receivers are not practical for use with live batters who tend to block the light beams. Thus, it is desirable to provide a baseball strike indicator which can be used in a real base-ball game setting and which provides a visual indicator to an umpire when a ball passes through the Strike Zone.

SUMMARY OF THE INVENTION

According to one aspect of the present invention, there is provided a device for indicating if a thrown object of known dimensions passes through a preselected volume. The indicating device comprises a first light source for emitting an array of spaced-apart parallel, distinct light beams in a first direction, a second light source for emitting an array of spaced-apart parallel, distinct light beams in a second direction such that the light beams from the first and second light sources intersect entirely within the preselected volume, the spacing of the light beams being such that light beams from each of said first and second light sources will shine simultaneously on the thrown object when the object is within the preselected volume so as to provide a visual indication that the object is within the preselected volume. Preferably, the preselected volume represents a strike zone for a pitched ball.

According to a further aspect of the invention, there is provided light indication apparatus comprising a first light source for emitting variably spaced first laser generated rays in a first direction, and a second light source for emitting second laser generated rays in a second direction, wherein the first and second light rays intersect entirely within a variable preselected volume, and an object having sufficiently large dimensions can be identified by an observer of the first and second light rays as being substantially within the volume when the first and second light rays shine on the object simultaneously. Preferably, the object is a baseball, and the first laser generated rays are of a different color than the second laser generated rays.

DETAILED DESCRIPTION OF PREFERRED EMBODIMENT

If a plurality of laser beams are emitted in one direction and another plurality of laser beams are emitted in a perpendicular direction, the following must be true assuming at least two laser beams intersect and that no other laser beams exist. There is an infinite volume wherein there exists no intersection between laser beams traveling in different directions. There is a finite volume inside of which all laser beam intersection occurs.

Figure 1:
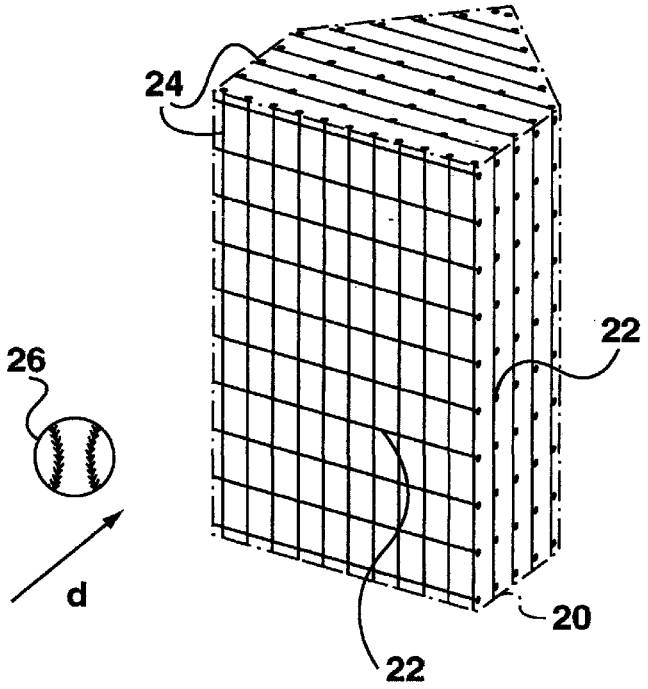
FIG. 1 is a perspective view of a baseball traveling towards intersecting grids of laser beams.

In FIG. 1, a strike volume 20 is defined within dashed lines. The volume 20 is an example of the above-mentioned finite volume wherein all intersection occurs. The dimensions of the strike volume 20 model the dimensions of an actual Strike Zone. In particular, the top, bottom, right side and left side of the strike volume 20 correspond to the midpoint between the top of the shoulders and the top of the uniform pants of a batter, the hollow beneath the knee cap of the batter, the right side of home plate and the left side of home plate respectively (right and left being from the perspective of the umpire). As the top and bottom of the strike volume 20 will vary depending on the batter, the strike volume 20 is not constant.

The apparatus of the present invention includes one light source device for emitting an array of spaced-apart parallel, distinct laser beams 22 in a horizontal direction, and a further light source device for emitting an array of spaced-apart parallel, distinct laser beams 24 in a vertical direction. The horizontal laser beams 22 and vertical laser beams 24 are directed through and intersect in the strike volume 20. Preferably the horizontal and vertical laser beams are of a different color. In one preferred embodiment, one of the horizontal and vertical laser beams is red and the other is green.

The horizontal and vertical laser beams form a three dimensional detection grid in strike volume 20. According to a preferred embodiment, the detection grid is sufficiently tight so that a baseball 26 traveling in a direction d always intersects both a horizontal laser beam 22 and a vertical laser beam 24 when the baseball 26 is substantially within the front portion of the strike volume 20. In this preferred embodiment the baseball 26 has a diameter of 2.9 inches.

In order to determine whether or not the baseball has passed substantially into the strike volume 20 during its course from the hand of a pitcher to the glove of a catcher, one must answer the question of whether or not the baseball 26 has been lit simultaneously by two different colored laser beams (a horizontal and a vertical laser beam). If the answer is yes, then the baseball 26 passed substantially into the volume 20 and the pitch can be called a strike. If the answer is no, then the baseball did not pass substantially into the strike volume and the pitch can be called a ball.

Because the laser beams 22 and 24 travel both inside and outside the volume 20, it is possible that the baseball 26 could pass through vertical laser beams 24 and/or horizontal laser beams 22 from the hand of a pitcher to the glove of a catcher without the baseball passing through the strike volume 20. It is however not possible that the baseball could pass through both horizontal and vertical laser beams at the same time without the baseball also passing substantially into the strike volume 20.

Figure 2:
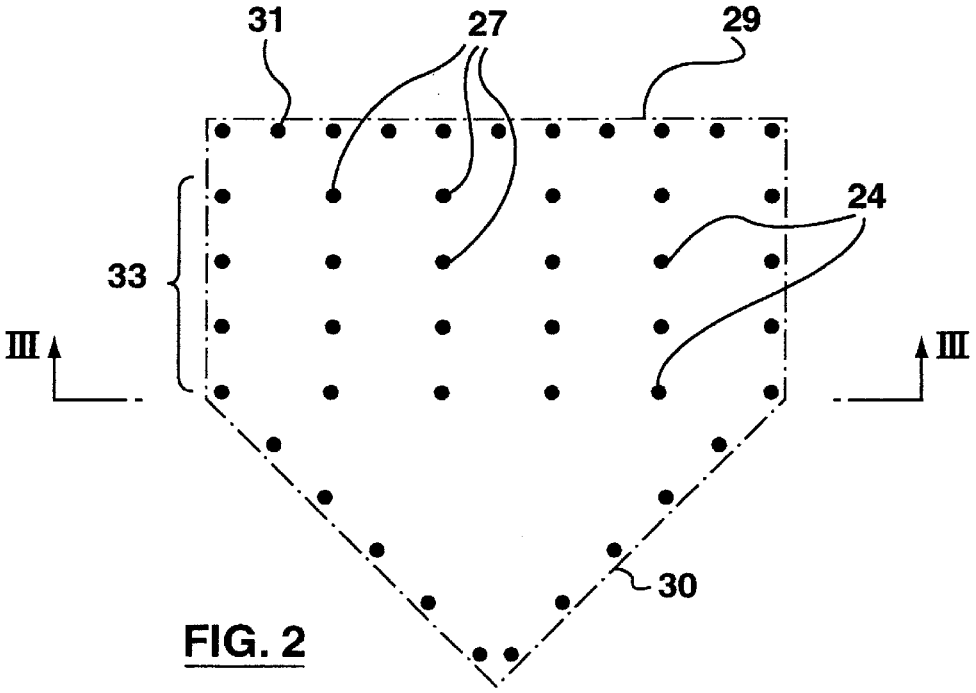
FIG. 2 is a top view of a home plate shaped laser emitting device constructed in accordance with the invention.
Figure 3:
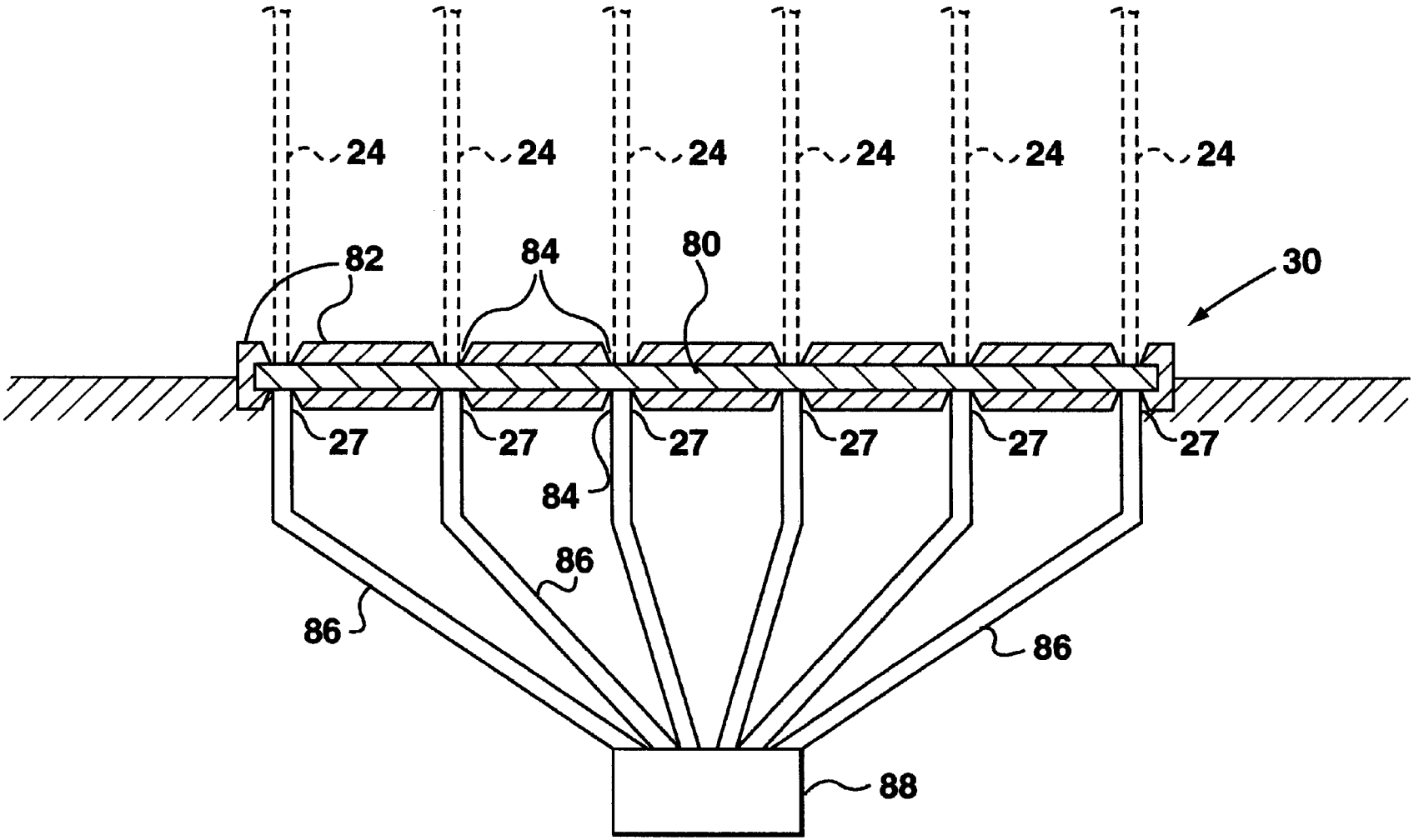
FIG. 3 is a cross-sectional view of the home plate shaped laser emitting device, taken along the line III—III of FIG. 2.

The devices for emitting the horizontal and vertical laser beams 22, 24 will now be described in greater detail. With reference to FIGS. 2 and 3 the light source device for emitting vertical beams 24 preferably includes a home-plate shaped device 30 which includes a plurality of upwardly-directed laser beam emitters 27 for emitting light beams 24. Preferably, the rectangular portion of the home-plate 30 include a plurality of uniformly-spaced rows 33 of uniformly-spaced laser beam emitters 27.

The laser beam emitters in front row 31 can be spaced closer together. An advantage of doing this would be to provide a visual indicator to an umpire whether or not the bat of a batter has passed across the home plate 30 as a result of the batter's swing.

In the illustrated embodiment the home base device 30 is dimensioned slightly larger than a normal home plate to allow the laser beam emitters 27 that are located around the perimeter of the plate 30 to be set in from the edges of the plate 30. Preferably, the home base device 30 includes a transparent protective sheet 80 that is positioned over laser emitters 27 to protect them. The transparent sheet 80 is encased in a resilient coating 82 which includes a plurality of openings 84 on the upper and lower sides of transparent sheet 80 to allow laser emitters 27 to emit laser beams through the transparent sheet 80. The openings 84 provided through the coating 82 are either large enough or small enough so that a player's shoe cleats will not wedge in the openings. The resilient coating 82 is preferably made from a non-slip material, such as rubber, to provide traction.

In one embodiment of the invention, each of the laser emitters 27 may comprise a fibre optic wave guide 86 that has- an emitting end located at plate 30, and which is connected at its opposite end to a laser beam generator 88, thus permitting a single laser beam generator 88 be used to generate all light beams 24.

It will be appreciated that home plate device 30 could take many other configurations in addition to that described herein.

Figure 4:
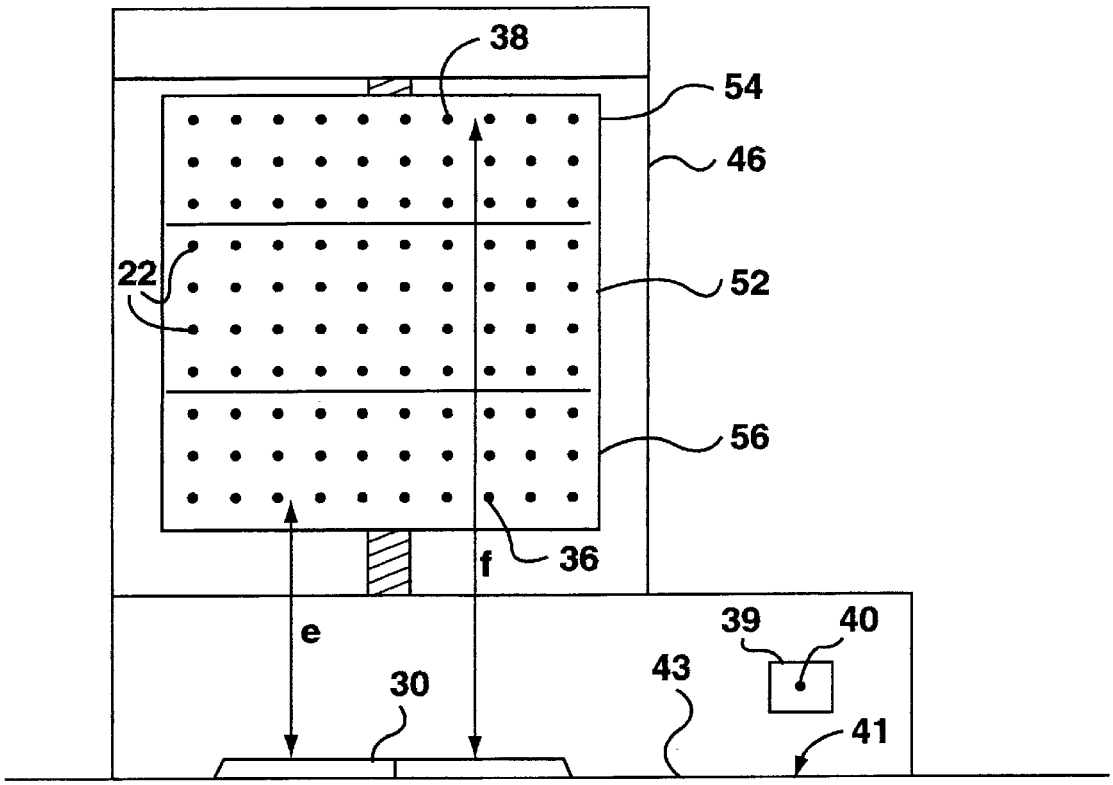
FIG. 4 is a side elevational view of a device for emitting horizontally directed laser beams.

In FIG. 4, a light source device 54 for emitting the horizontal beams 22 is illustrated. The beams 22 form a rectangular array of a plurality of uniformly-spaced rows of uniformly-spaced beams, with a bottom row 36 and a top row 38. Both the distance e between the bottom row 36 and the plate 30, and the distance f between the top row 38 and the plate 30 vary according to the particular batter. For example, the distances e and f are longer for a batter having a height of 6'11" than a batter having a height of 5'11".

An additional light source 39 can be provided for emitting a laser beam 40 which is directed directly above and parallel to the back line 41 of a batter's box. The exact distance between ground 43 and the beam 40 is preferably not greater than 1 foot. In one embodiment, two laser beams are directed above and parallel to the back line of the batter's box. The two laser beams would be one and two inches above ground level.

Batters frequently try to stand as far back in the batter's box as possible. This is because the further a batter stands back in his batter's box, the longer the pitch response time a batter obtains. If a batter hits a baseball while one of his feet is outside of the batter's box, the batter will be called out. To avoid the chance of one of his feet being caught behind the back line of his batter's box, the batter will run that foot back and forth along the back line of his box. Because the batter's box is only indicated by chalk, a batter doing this eventually erases a significant portion of the back line.

Figure 5:
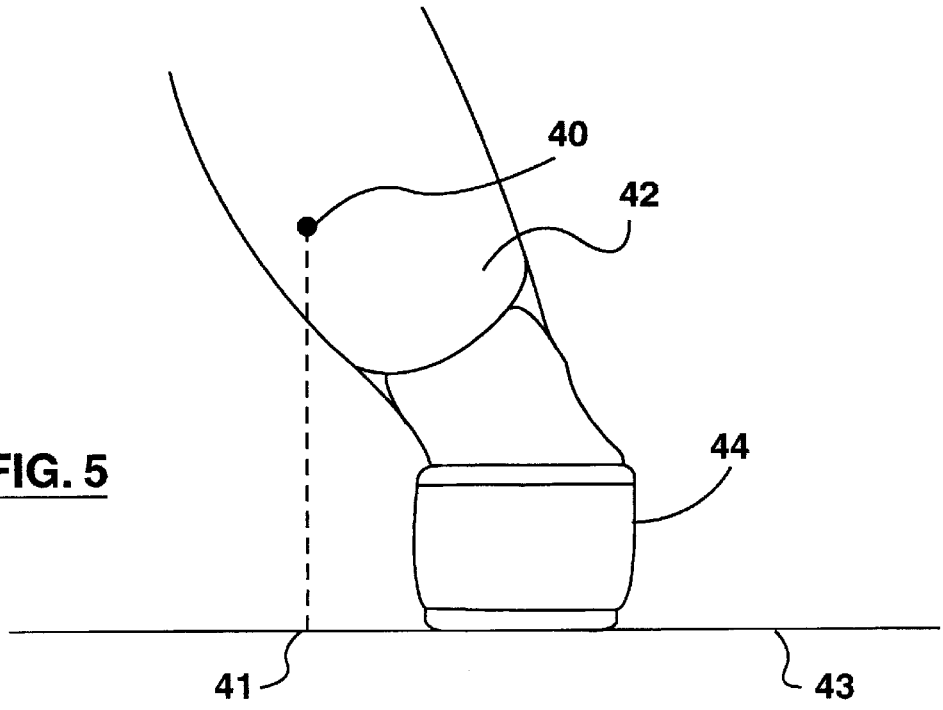
FIG. 5 is a side elevational view of the right foot of a batter.

FIG. 5 illustrates a situation where a batter's foot 44 is outside of his batter's box. In this situation a home plate umpire will notice that the laser beam 40 is shining onto uniform pants 42 of the batter. The portion of the batter which is in front of the beam 40 will be inside of the batter's box, and the portion of the batter substantially behind the beam 40 will be outside of the batter's box. Therefore if a batter hits a baseball with his foot 44 in the position as illustrated, an umpire would correctly call the batter out because the foot 44 would be substantially behind the beam 40. It will be appreciated however that the beam 40 does not need to shine on the batter in order to serve as an indicator for the back line of a batter's box.

Figure 6:
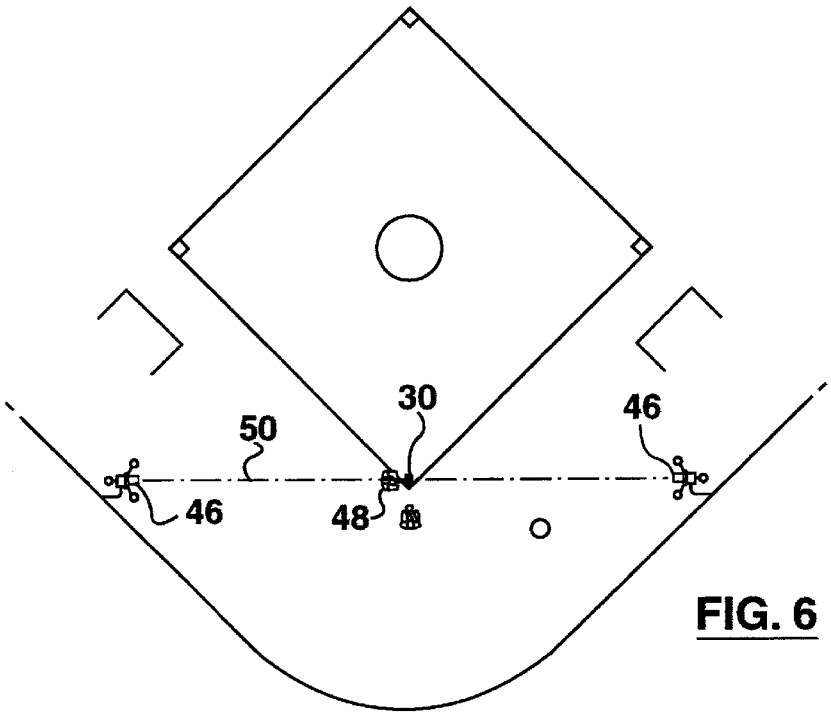
FIG. 6 is a top view of a baseball diamond.

Conveniently, two horizontal light source devices 46 can be used as part of the present invention. Turning to FIG. 6, two possible locations for light source devices 46 for generating horizontal beams 22 are shown. It is likely that the light source devices 46 could be hit by a stray foul ball in these locations. In order to protect the light source devices 46 from damage, they are preferably housed in wire cages or protected by wire fencing. The light source devices 46 shine horizontal laser beams 22 across the home plate 30. It is noted that batter 48 stands in the laser beam path 50 of one or the other of light source devices 46, depending on whether the batter hits left or right. Consequently one of the devices 46 will preferably not emit laser beams. If the batter 48 stands in the left batter's box as illustrated, the device 46 on the third base side will not emit laser beams. If the batter 48 stands in the right batter's box, the device 46 on the first base side will not emit laser beams.

Figure 7:
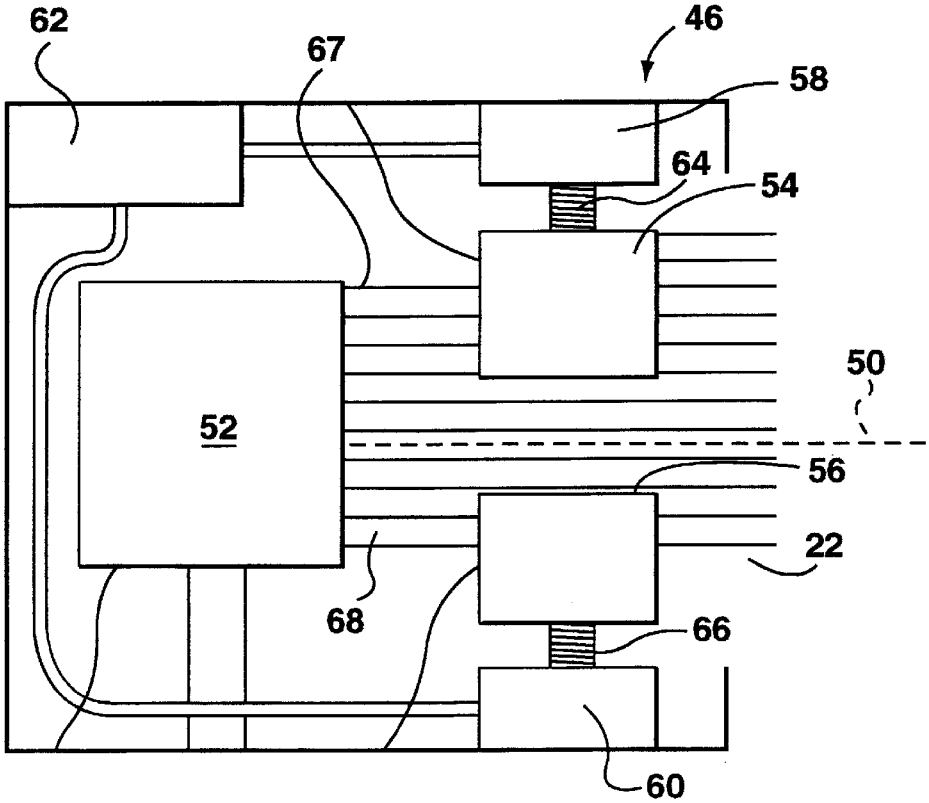
FIG. 7 is a light source device of FIG. 4.

One possible construction of the light source device 46 is shown in FIGS. 4 and 7. This embodiment of light source device 46 includes a middle laser beam emitter device 52, a top laser beam emitter device source 54 and a bottom emitter device 56. Each of the emitter devices 52, 54 and 56 include a plurality of rows of parallel laser beam emitters for emitting horizontal light beams. The laser beam source 39 for generating the laser beam 40 that defines the back of the batter's box is preferably also housed within device 46. Each laser beam emitter device could have a single laser beam generator whose beam would be broken up by a suitable arrangement of beam splitters and mirrors into several beams to be emitted from laser beam emitters. It would also be possible to have only a single laser in the device 46 with light being transmitted to each of the laser beam emitters of the emitter devices 52, 54 and 56 by way of fiber optic wave guides. In another case each of the beams 22 would originate from a different laser beam generator. All of these possibilities would be straightforward to implement for one skilled in the art.

Given the possibility that one of the beams 22 and 24 could contact the eye of an individual on the baseball field, Class 1 eye safe laser beam generators should be used in both the home plate 30 and the horizontal light source devices 46. One manufacturer of Class 1 eye safe lasers is Advanced Laser Systems Technology, Inc. of Orlando, Fla.

In order to vary the distances e and f discussed previously, it is necessary that the top emitter device 54 and the bottom emitter device 56 be capable of moving in a vertical direction. Two actuator boxes 58 and 60 controlled by a computer 62 are provided for this. Each actuator box contains a computer controlled electric motor having a motor shaft. The motor shaft is connected to a transmission which has a drive shaft. According to the information provided by the computer 62, threaded shafts 64 and 66 raise or lower emitter devices 54 and 56 as required. It is noted that the bottom of emitter device 54 cannot be raised significantly higher than light beam 67, and that the top of emitter device 56 cannot be lowered significantly lower than light beam 68 in order to maintain a tightly spaced grid within the strike volume 20.

It will be appreciated that the top and bottom of the batters' strike zones are determined before the apparatus of the present invention is employed, and that such measurements are not taken by the apparatus presently discussed. The computer 62 will require information concerning where the tops and bottoms of the batters' strike zones are in order to adjust the heights of the sources 54 and 56 accordingly. Preferably the computer 62 uses a differential height adjustment system (i.e. the heights of the emitter devices 54 and 56 are adjusted based on the height differential between the current height and the previous height).

Figure 8:
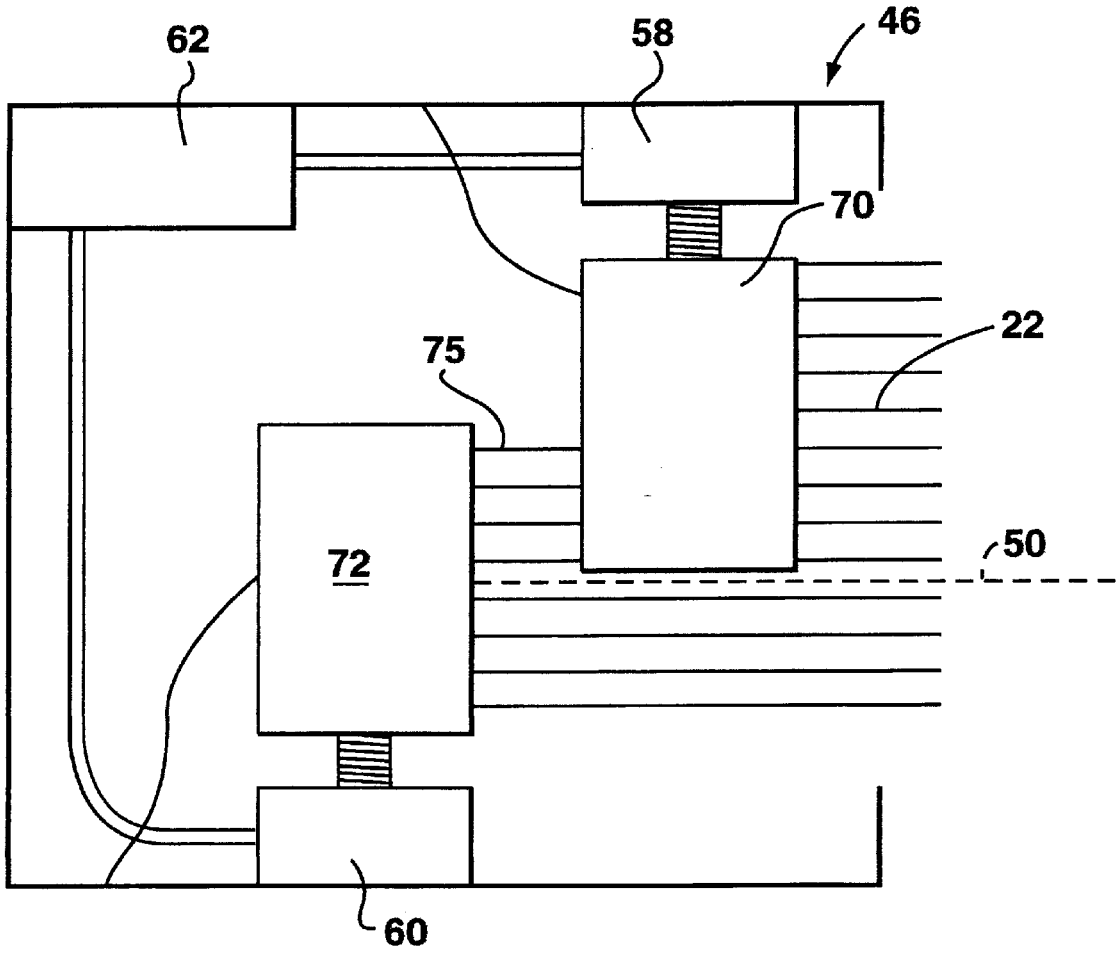
FIG. 8 is another embodiment of the light source device constructed in accordance with the invention.

In alternative embodiment of device 46 (FIG. 8) there are only two laser beam emitter devices 70 and 72. To produce equivalent results, the emitter devices 70 and 72 must span a greater vertical distance than the emitter devices 54 and 56. It is also noted that the bottom of emitter device 70 must not be raised significantly higher than light beam 75.

It will be appreciated by those skilled in this art that various modifications and changes can be made to the described laser indicator apparatus without departing from the spirit and scope of this invention. Accordingly, all such modifications and changes as fall within the scope of the appended claims are intended to be part of this invention.

I claim:

1. An apparatus for visually indicating if a thrown object of known dimensions passes through a preselected volume, comprising:

a first light source for emitting an array of spaced-apart parallel, distinct light beams of a first color in a first direction;

a second light source for emitting an array of spaced-part parallel, distinct light beams of a second color different from said first color in a second direction such that the light beams from the first and second light sources intersect entirely within the preselected volume, the spacing of the light beams being such that light beams from each of said first and second light sources will shine simultaneously on the thrown object when the object is within the preselected volume so as to provide a visual indication that the object is within the preselected volume.

2. An apparatus according to claim 1 wherein the arrays of light beams emitted by said first and second light sources each include a plurality of uniformly-spaced rows of uniformly-spaced light beams.

3. An apparatus according to claim 1 wherein the preselected volume represents a strike zone for a pitched ball.

4. An apparatus according to claim 3 wherein one of said first and second light sources includes a home-plate shaped device from which the array of light beams emitted by such light source are directed vertically.

5. An apparatus according to claim 4 wherein the array of light beams directed vertically from the home-plate shaped device includes a plurality of rows of light beams.

6. An apparatus according to claim 5 wherein a row of light beams are emitted vertically along a front portion of the home-plate shaped device that are spaced closer together than at least some of the other rows of vertically-directed light beams in order to provide a visual indicator when a bat has been swung completely through the strike zone.

7. An apparatus according to claim 3 wherein said first and second light sources further include laser beam generators, and said first and second light beams are generated by said laser beam generators.

8. An apparatus according to claim 3 wherein said first direction is generally perpendicular to said second direction.

9. An apparatus according to claim 8 wherein said preselected volume has a geometric shape, the geometric shape having at least seven faces.

10. An apparatus according to claim 3 wherein said first light source emits a rectangular array of horizontally-directed light beams wherein the location of the top and bottom of the rectangular array can be adjusted such that the strike zone can be adjusted.

11. An apparatus according to claim 10 including a third light source for selectively emitting an array of spaced-apart parallel, distinct light beams in a third direction that is opposite the first direction in order to intersect with the light beams from the second light source within the preselected volume, thus permitting the indicating device to be used with both left-handed and right-handed batters.

12. An apparatus according to claim 3 including a further light source for visually identifying a location of a back line of a batter's box by directing a light beam parallel to and above the back line.

13. An apparatus according to claim 1 wherein the number and location of the light beams emitted by one of said first and second light beam sources is controlled by a computer.

14. An apparatus for visually indicating if a thrown object of known dimensions passes through a variable preselected volume, comprising:

a first light source for emitting variably-spaced first laser generated rays of a first color in a first direction; and a second light source for emitting second laser-generated rays of a second color different from said first color in a second direction;

wherein said first and second light rays intersect entirely within the variable preselected volume, and an object having sufficiently large dimensions can be identified visually by an observer as being substantially within said volume when said first and second light rays shine on said object simultaneously.

15. An apparatus according to claim 14 wherein said object is a baseball.

16. An apparatus according to claim 14 wherein said first direction is generally perpendicular to said second direction.

17. An apparatus according to claim 14 wherein the number and location of said first laser-generated rays is controlled by a computer.

18. An apparatus according to claim 14 including a further light source for emitting a laser-generated ray to indicate a location of a back line of a batter's box.

* * * * *